United States Patent [19]

Nakazato et al.

[11] Patent Number: 4,973,179

[45] Date of Patent: Nov. 27, 1990

[54] CLIP ACTUATED LATCH MECHANISM FOR RETRACTABLE WRITING INSTRUMENTS

[75] Inventors: Youichi Nakazato; Masuo Kubota; Shuhei Kageyama; Yoshihide Mitsuya, all of Kawagoe, Japan

[73] Assignee: Kotobuki & Co., Ltd., Kyoto, Japan

[21] Appl. No.: 336,674

[22] Filed: Apr. 12, 1989

[30] Foreign Application Priority Data

| | | | |
|---|---|---|---|
| Apr. 13, 1988 | [JP] | Japan | 63-50108 |
| Nov. 25, 1988 | [JP] | Japan | 63-153875 |
| Dec. 12, 1988 | [JP] | Japan | 63-161714 |
| Dec. 12, 1988 | [JP] | Japan | 63-161715 |

[51] Int. Cl.[5] ..... B43K 21/06; B43K 24/04

[52] U.S. Cl. ..... 401/104; 401/106

[58] Field of Search ..... 401/104, 105, 106

[56] References Cited

U.S. PATENT DOCUMENTS

| | | | |
|---|---|---|---|
| 2,583,142 | 1/1952 | Frentzel | 401/106 |
| 3,071,112 | 1/1963 | Lovejoy | 401/106 |
| 4,717,275 | 1/1988 | Burkhardt | 401/104 |
| 4,790,678 | 12/1988 | Araki | 401/104 |

*Primary Examiner*—Richard J. Johnson

*Attorney, Agent, or Firm*—Donald D. Mon; David O'Reilly

[57] ABSTRACT

Mechanism for putting the head of a shaft into and out of the head of an outer sleeve comprised of an outer sleeve (1), a long hole (2) formed in the outer sleeve (1), and a clip (3) to be put into and out of the outer sleeve (1) through the long hole (2). A shaft (4) is inserted in the outer sleeve (1), and a cam mechanism (8) cooperates with the clip (3) in a manner that causes the cam mechanism (8) to move forward and backward in an axial direction according to in and out movement of the clip (3). A spring (6) spring-biases the shaft (4) toward the cam mechanism.

4 Claims, 9 Drawing Sheets

CLIP ACTUATED LATCH MECHANISM FOR RETRACTABLE WRITING INSTRUMENTS

BACKGROUND OF THE INVENTION

This invention relates to a mechanism for putting the head of a writing shaft in and out, for example, a ball-point pen, mechanical pencil, or cutter into and out of an outer sleeve.

DESCRIPTION OF THE PRIOR ART

Heretofore, a writing tool such as a ball-point pen, or mechanical pencil, are provided with a clip fixed at an outer sleeve thereof. The fixed clip disturbs writing or drawing, particularly when a line with uniform thickness is drawn by rotating the outer sleeve of a writing tool, since the fixed clip projects out from the outer sleeve.

Also, there is a writing tool with a clip which is removably attached to the outer sleeve, in which when taking notes the clip is removed from the outer sleeve while when carrying the writing tool the clip is attached to the outer sleeve. This writing tool has the disadvantage that attachment and removal of the clip is troublesome.

BRIEF SUMMARY OF THE INVENTION

Accordingly is is an object of the present invention to provide a mechanism for putting the head of writing shaft in and out in which a clip can be put in and out from an outer sleeve while the head of the writing shaft can be put in and out from the above object is accomplished by a mechanism for putting the head of the shaft in and out through the head end of an outer sleeve into and out of the outer sleeve comprising an outer sleeve 1, a long hole 2 formed in the outer sleeve 1, a clip 3 which is put in and out through the long hole 2 into and out of the outer sleeve 1. Shaft 4 is inserted in the outer sleeve 1, and a cam mechanism 8 cooperates with the clip 3 in such a manner that mover cam mechanism 8 forward and backward in an axial direction according to the movement of the clip 3 which is put in and out, and a spring 6 with which the shaft 4 is spring-biased toward the cam mechanism.

Further, the above object is accomplished by a mechanism for putting the head of the shaft in and out through the head of an outer sleeve into and out of the outer sleeve comprising an outer sleeve 1, a long hole 2 formed in the outer sleeve 1, a clip 3 which is put in and out through the long hole 2 into and out of the outer sleeve 1, a shaft 4 which is inserted in the outer sleeve 1, a cam mechanism 8 which cooperates with the clip 3 in such a manner that the cam mechanism 8 is moved forward and backward in the axial direction according to the movement of the clip 3 being put in and out. A spring 6 with which the shaft 4 is spring-biased toward the mechanism is provided, wherein said mechanism comprises front and rear retaining parts 10*a* and 10*b* formed in a base part 9 of the clip 3 which engage with the front and rear edge portions of the outer sleeve 1, respectively. A retaining hole 11 is formed in the base part 9 of the clip 3, moving member 15 including a front slope 12 which descends toward the rear portion thereof and on which the front retaining part 10*a* of the clip 3 is slidable, a retaining part 13 for retaining the front retaining part 10*a*, said retaining part 13 being formed behind the front slope 12, and a rear slope 14 which descends toward the rear portion thereof and which is retained with the retaining hole 11 of the clip 3, said moving member 15 being positioned at the rear portion of the shaft 4.

Further the above object is accomplished by a mechanism for putting the head of the shaft in and out through the head of an outer sleeve into and out of the outer sleeve comprising an outer sleeve 101, a long hole 102 formed in the outer sleeve 101, a clip 103 which being put in and out through the long hole 102 into and out of the outer sleeve 101, a shaft 104 which is inserted in the outer sleeve 101, a cam mechanism 108 which cooperates with the clip 103 in such a manner that the cam mechanism 108 is moved forward and backward in the axial direction according to the movement of the clip 103 which is put in and out. A spring 106 is provided with which the the shaft 104 is spring-biased toward the cam mechanism, wherein said mechanism comprises front and rear retaining parts 110*a*, 110*b* formed in a base part 109 of the clip 103 which engages with the front and rear edge portion of the outer sleeve 101, respectively. A retaining hole 111 is formed in the base part 109 of the clip 103, and a moving member 115 including a front slope 112 which descends toward the rear portion is provided thereof and on which the front retaining part 110*a* of the clip 103 is slidable are provided. A retaining part 113 is provided for retaining the front retaining part 110*a*, said retaining part 113 being formed behind the front slope 112. A rear slope 114 descends toward the rear portion thereof and is retained with the retaining hole 111 of the clip 103, and plural insertion holes 118*a*, 118*b*, etc.. which are adapted to shafts with different diameters. Moving member 115 is attached to the rear portion of the shaft 104 by insertion of the rear end of the shaft 104 into the insertion hole of the moving member 115.

Furthermore, the above object is accomplished by a mechanism of putting the head of the shaft in and out through the head of an outer sleeve into and out of the outer sleeve comprising an outer sleeve 201, a long hole 202 formed in the outer sleeve 201, a clip 203 is put in and out through the long hole 202 into and out of the outer sleeve 201, a shaft 204 is inserted in the outer sleeve 201, a cam mechanism 208 which cooperates with the clip 203 in such a manner that the cam mechanism 208 is moved forward and backward in the axial direction according to the movement of the clip 203 being put in and out. A spring 206 is provided with which the shaft 204 is spring-biased toward the cam mechanism, wherein said mechanism comprises front and rear retaining parts 210*a*, 210*b* formed in a base part 209 of the clip 203 which are engaged with the front and rear edge portions of the outer sleeve 201, respectively. A retaining hole 211 is formed in the base part 209 of the clip 203, and a moving member 215 is provided including a front slope 212 which descends toward the rear portion thereof and on which the front retaining part 210*a* of the clip 203 is slidable. A retaining part 213 is provided for retaining the front retaining part 210*a*, said retaining part 213 being formed behind the front slope 212, and a rear slope 214 descends toward the rear portion thereof and is retained with the retaining hole 211 of the clip 203. Moving member 215 is positioned at the rear portion of the shaft 204, the base area of the cam mechanism of the front retaining part 210*a* is retained with the retaining part 213 provided with a retaining hole 219*a* and a portion of the outer sleeve 201 is provided with a projection for release 220 and a cut 222 while the moving member 215 is provided with an insertion hole 221 in which the projection for release 220 is inserted.

Furthermore, the above object is accomplished by a mechanism for putting the head of the shaft in and out through the head of an outer sleeve into and out of the outer sleeve comprising an outer sleeve 301, a long hole 302 formed in the outer sleeve 301, a clip 303 which is put in and out through the long hole 302 into and out of the outer sleeve 301, a shaft 304 is inserted in the outer sleeve 301, a cam mechanism 308 which cooperates with the clip 303 in such a manner that the cam mechanism 308 is moved forward and backward in the axial direction according to the movement of the clip 303 being put in and out. A spring 306 is provided with which the shaft 304 is spring-biased toward the cam mechanism, wherein said mechanism comprises front and rear retaining parts 310*a*, 310*b* formed in a base part of the clip 303 engaged with the front and rear edge portions of the outer sleeve 301, respectively. A retaining hole 311 is formed in the base part 309 of the clip 303 and a moving member 315 includes a front slope 312 which descends toward the rear portion thereof and on which the front retaining art 210*a* of the clip 303 is slidable. Retaining part 313 retains the front retaining part 310*a*, said retaining part 313 being formed behind the front slope 312, and a rear slope 314 which descends toward the rear portion thereof and is retained with the retaining hole 311 of the clip 303. Moving member 315 is positioned at the rear portion of the shaft 304, a portion of the outer sleeve 301 facing the base portion on the side of the front retaining part 310*a* is retained therewith an a portion of the moving part 315 of the cam mechanism 308 is provided with retaining holes 319*a*, 319*b*, respectively. Release operation member 320 is inserted in the insertion hole 319 of the retaining hole 319*a* positioned facing the base part on the side of the front retaining part 310 and an insertion hole 321 in which the release operation member 320 is inserted is formed in the moving member 315.

BRIEF DESCRIPTION OF THE DRAWINGS

In the drawings,

FIGS. 5(*a*)–(*c*) are partial sectional views showing various examples for connecting part of cam mechanisms according to the present invention which are connected with shafts, respectively, FIGS. 6(*a*) and (*b*) are partial vertical sectional views of an another embodiment of cam mechanisms according to the present invention, (a) showing the state of the clip when projected out and (b) the state when the clip is drawn in.

DETAILED DESCRIPTION OF THE DRAWINGS

Figure 1:
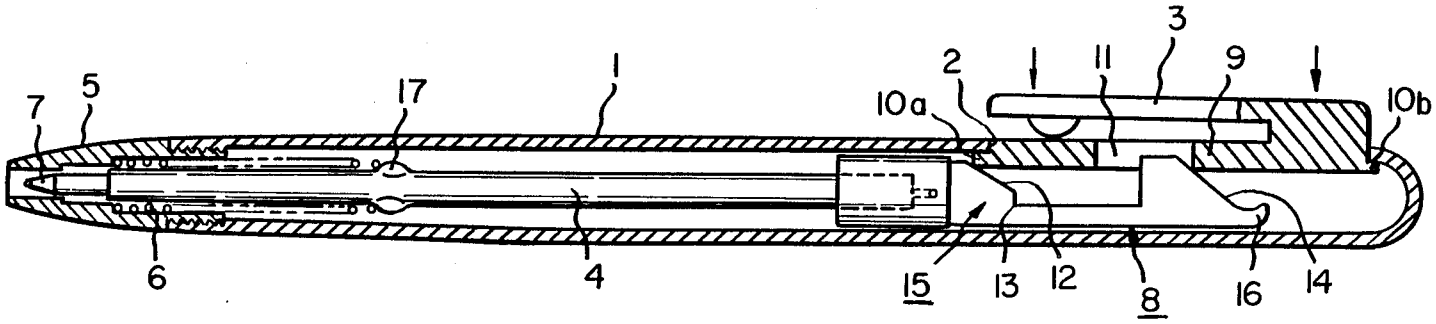
FIG. 1 is a vertical section showing the construction of a first embodiment of a mechanism according to the present invention.
Figure 2:
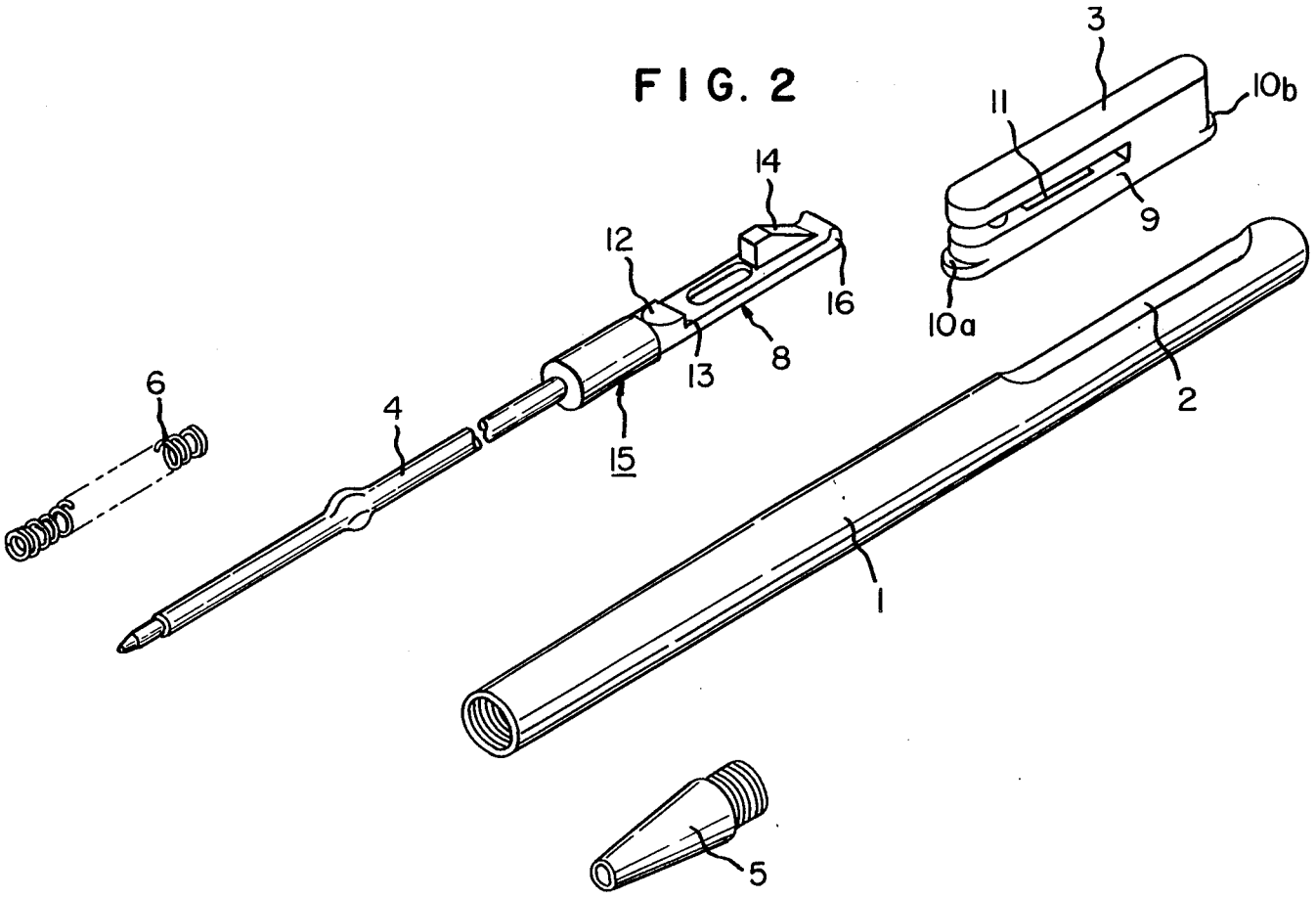
FIG. 2 is an exploded view thereof.

Referring first to the embodiment of the present invention shown in FIGS. 1 and 2, numeral 1 designates an outer sleeve and numeral 2 designates a long hole in the axial direction made in the rear portion of the outer sleeve 1. A clip 3 is put in and out through the long hole 2. As spring 6 is inserted between a spring bearing 17 on a writing shaft, for example, of a ball-point pen 4 and a head member 5. Numeral 8 designates a cam mechanism with which the head of ball-point pen 7 of the writing shaft 4 can be put in and out, according to the operation for putting in and out the clip 3, against or through the spring force f the spring 6, which is provided between the writing shaft 4 and the clip 3.

The cam mechanism 8 comprises front and rear retaining parts 10*a*, 10*b* formed in a base part 9 of the clip 3 which engage front and rear edge portions of the long hole 2 of the outer sleeve 1, respectively. A retaining hole 11 is formed in the central part of the base part 9, and a moving member 15 including a front slope 12 is formed in the front which descends toward the rear thereof on which the front retaining part 10*a* is slidable. Retaining part 13 is formed behind the front slope 12 and with which the front retaining part 10*a* is retained, and a rear slope 14 descends toward the rear thereof and is retained by the retaining hole 11, and a small projection 16 formed behind the rear slope 14. The forward portion of the moving member is attached to the rear portion of the writing shaft 4 by way of insertion.

In the above construction, for example, when the writing tool is used, the forward part of the clip 3 is pushed, by which the front slope 12 and the rear slope 14 are pushed by the front retaining part 10*a* and the edge of the retaining hole 11 formed in the base part 9 of the clip 3, respectively, causing the moving member 15 and the writing shaft for ball-point pen 4 to be moved forward against the spring 6 so that the head of ball-point pen 7 of the writing shaft 4 is projected out of the head member 5. At the same time the front retaining part 10*a*slides on the front slope 12 to the retaining part 13 and is retained therewith so that the clip 3 is kept drawn in.

Further, for example, in carrying the writing tool or in drawing in the head of ball-point pen 7 of the writing shaft 4 in the outer sleeve, the rear part of the clip 3 is pushed, by which the base part 9 of the clip 3 is moved outward and supported on the small projection 16 as the fulcrum and utilizing the principles of the lever and fulcrum so that the front retaining part 10*a* is released from the retaining part 13 so as to slide on the front slope 12 while the rear slope 14 presses against the edge of the retaining hole 11 causing the moving member 15 to move lightly forward against the spring 6 so that the front retaining part 10*a* is released from the rear retaining part 13 behind the front slope 12 and slides on the front slide 12. Thereafter the writing shaft for ball-point pen 4 and the moving member 15 are moved backward with the spring force of the spring 6 and this movement makes the clip 3 project out.

In this case, it is preferable that the cam mechanism according to the invention be provided with the small projection 16 behind the rear slope 14, because the contact of the base part 9 of the clip 3 with the small projection 16 enables a smooth release of the front retaining part 10*a* from the retaining part 13 when the clip 8 is pressed.

According to the present embodiment, for example, when using the writing tool (in taking notes), the forward part of the clip 3 is pushed causing the cam mechanism 8 to be moved against the spring 6, with the clip 3 being drawn in while the head of ball-point pen 7 of the writing shaft for ball-point pen 4 is projected out of the head member 5. Therefore it is possible to take notes without interference by the clip 3 since both the state of the clip 3 drawn in and the state of the head of ball-point pen 7 of the writing shaft 4 projected out of the head member can be maintained. Besides, for example, in carrying the writing tool or in drawing in the head of ball-point pen 7 of the writing shaft 4, the rear part of the clip 3 is pushed by which the cam mechanism 8 is moved with the spring force of the spring 6, thereby the state of the clip 3 being drawn in is released so that the clip 3 projects out while the head of ball-point pen 7 of the writing shaft 4 is drawn in through the head member 5 of the outer sleeve 1. Thus it is possible to carry the writing tool with a pocket being put between the clip. Further as the cam mechanism according to the present embodiment is formed with the clip 3 and the moving member 15, the number of parts can be reduced as compared with the usual rotary cam mechanism and can be manufactured at low cost.

The present embodiment is illustrated in the case of a cam mechanism for putting the head of the writing shaft in and out for a ball-point pen 4. But it goes without saying that the present invention can be applied to the shaft of a cutter.

Figure 3:
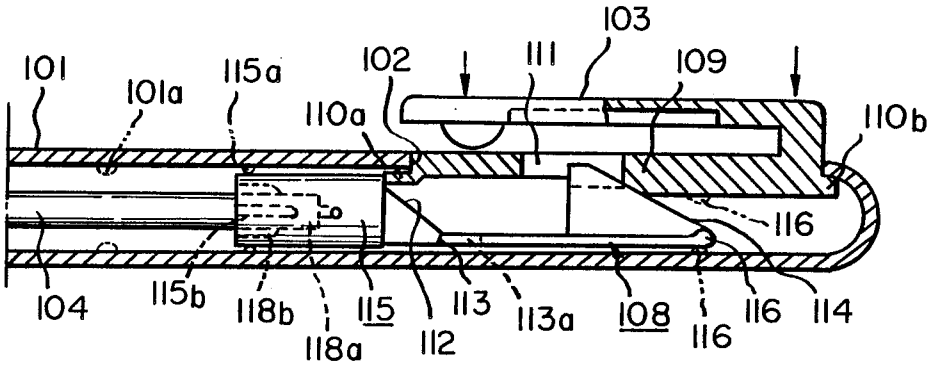
FIG. 3 is a partial vertical section showing the construction of a second embodiment of a mechanism according to the present invention.
Figure 4:
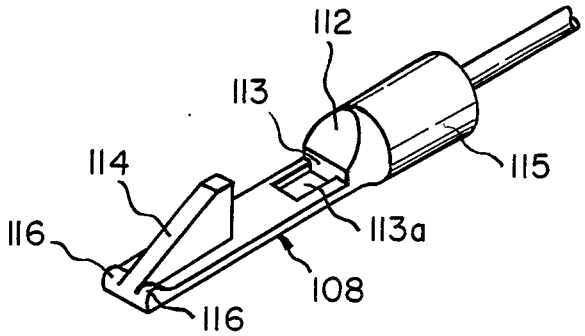
FIG. 4 is a perspective view of the cam mechanism shown in FIg. 3

Referring to another embodiment shown if FIGs. 3 and 4, numeral 101 designates an outer sleeve and numeral 102 designates a long hole in the axial direction made at the rear portion of the outer sleeve 101. A clip 103 is removably inserted in the long hole 102. A spring 106 is inserted between a spring bearing 117 of a writing shaft, for example, of a ball-point pen 104 and a head member 105. Numeral 108 designates a cam mechanism with which the head of ball-point pen 107 of the writing shaft 104 can be put in and out, according to the operation for putting in and out the clip 103, against or through the spring force of the spring 106, and is provided between the writing shaft 104 and the clip 103.

In this embodiment, a cam mechanism 108 comprises the front and rear retaining parts 110*a* and 110*b* formed in the base part 109 of the clip 103 which engage the front and rear edge portions of the outer sleeve 101, respectively. A retaining hole 111 in the axial direction is formed in the central part of the base part 109, and a moving member 115 having the front slope 112 is formed in the front and descends toward the rear thereof and on which the front retaining part 110*a* is slidable. Retaining part 113 is formed behind the front slope 112 and with the front retaining part 113 is retained. Rear slope 114 descends toward the rear thereof and is retained with the retaining hole 111, and the small projection 116 formed behind the rear slope 114, said forward portion of the moving member being connected with the rear portion of the writing shaft 104, the rear portion of the writing shaft 104 is inserted in one insertion hole 118*a* of two insertion holed 118*a*, 118*b* which are adapted for two kinds of writing shafts with outer diameters which are different from each other respectively (FIGS. 3 and 5(*b*)).

In this embodiment, the cam mechanism 108 is provided with a retaining hole 113*a* and front retaining part 110*a*.

In the above construction, for example, when the writing tool is used, the forward part of the clip 103 is pushed, by which the front slope and the rear slope 114 are pushed by the front retaining part 110*a* and the edge of the retaining hole 111 formed in the base part 109 of the clip 103, respectively. This causes the moving member 115 and the writing shaft for ball-point pen 104 to be moved forward against the spring 106 so that the head of the ball-point pen 107 of the writing shaft 104 is projected out of the head member 105. At the same time, the front retaining part 110*a* slides on the front slope 112, advances into the retaining hole 113*a* and is retained with the retaining part 113 so that the clip 103 can be maintained in the state of being drawn in (FIG. 6(*a*)).

Figure 6A:
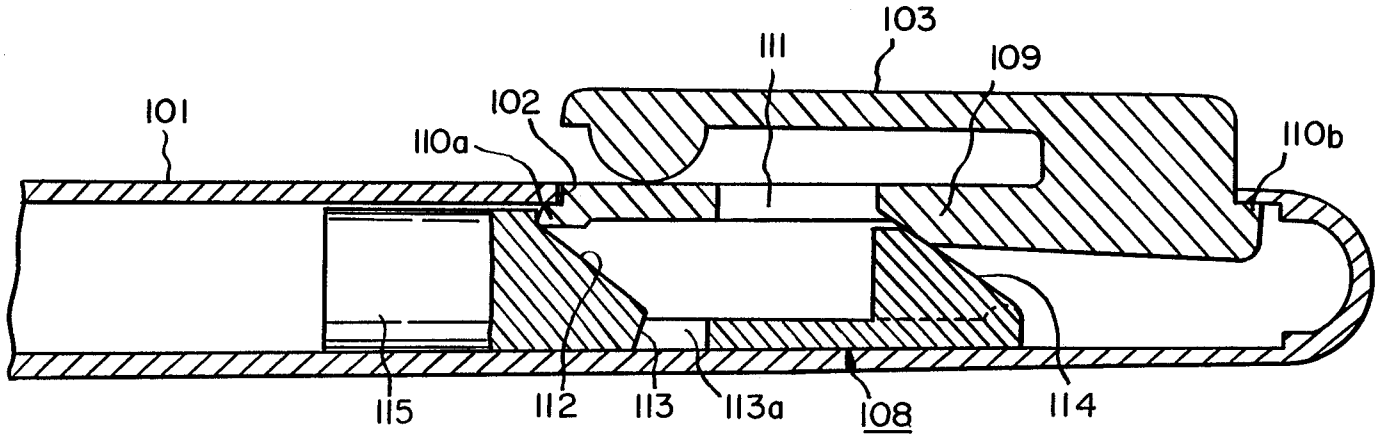
Figure 6B:
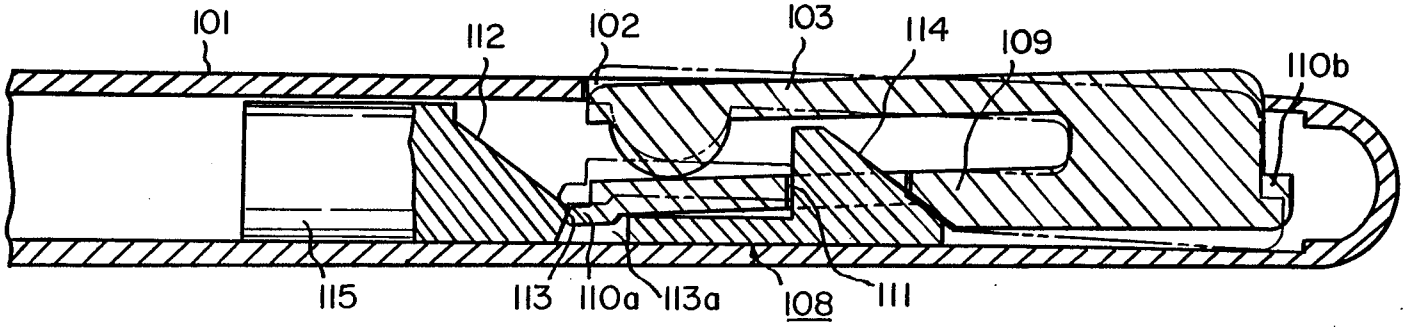

Further, for example, in carrying the writing tool or in drawing in the head of a ball-point pen in the outer sleeve the rear part of the clip 103 is pushed by which the base part 109 of the clip 103 is moved while being supported on the small projection 116 as the fulcrum and utilizing the principle of the lever and fulcrum so that the front retaining part 110*a* comes out of the retaining part 113 and is released from the retaining part 13 (as shown by phantom lines in FIG. 6). The slope 14 presses against a slanting surface about retaining hole 111 causing the moving member 115 to move slightly forward against the spring 106 and the writing shaft for ball-point pen 104 and the moving member 115 move backward with the spring force of the spring 106 and thus make the clip 103 project out (FIG. 6(*a*)).

In this case, it is preferable that the cam mechanism according to the invention is provided with the small projection 16 behind the rear slope 114, because the contact of the base part 109 of the clip with the small projection 116 enables the smooth release of the front retaining part 110 from the retaining part 113 utilizing the principles of the lever and fulcrum when the rear portion of the clip 103 is pushed. The projection 116 may be provided on both sides of the backward end of the rear slope 114. However, alternatively the projection 116 may be provided either on the lower surface of the clip 103 as shown by phantom lines in FIg. 3 or on the rear end of the lower surface of the cam mechanism 108 which is opposed to the inside of the outer sleeve 101.

Further, as the forward as the forward portion of the moving part 115 of the cam mechanism 108 is provided with the insertion holes 108*a* 108*b* which are adapted for two kinds of writing shafts with different outer diameters, if the writing shaft 104 has a larger outer diameter the writing shaft 104 can be inserted selectively in the insertion holes 118*b* with the larger inner diameter while if the writing shaft 104 has smaller outer diameter, the writing shaft 104 can be inserted in the holes 118*a* with smaller inner diameter.

Figure 5A:
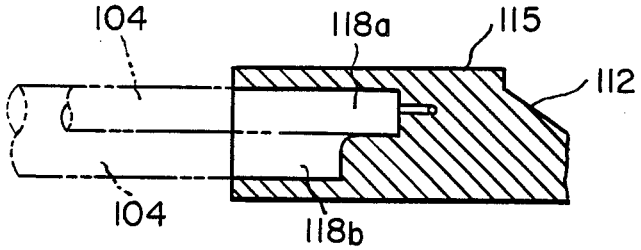
Figure 5B:
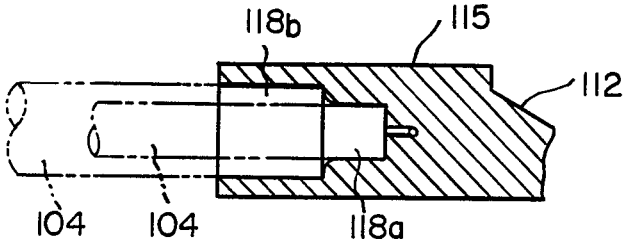
Figure 5C:
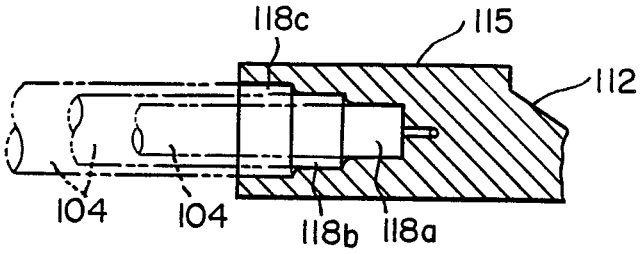

FIG. 5(*a*) shown an example of the insertion holes in which the moving member 115 is provided with two eccentric insertion holes 118*a*, 118*b* which have different inner diameters from each other. FIG. 5(*b*) shows another example of the insertion holes in which the moving member 115 is provided with two concentric insertion holes 118*a*, 118*b*. FIG. 5(*c*) shows a further example of the insertion holes 118*a*to 118*c* in which the moving member 115 is provided with three concentric insertion holes.

The number of insertion holes 118*a*, 118*b*, etc. is not restricted to two or three, but may be more.

According to the present embodiment, by pushing the forward portion of the clip 103, the clip 103 can be drawn in while the head of ball-point pen 107 of the writing shaft 104 can be projected out of the head member 105.

Further, as the forward portion of the moving member 115 is provided with plural insertion holes 118*a*, 118*b*, etc. for plural writing shafts having different diameters, an insertion hole can be selected according to the outer diameter of the writing shaft 104. Therefore, without increasing the number of parts use of various writing shafts having different diameters from each other is possible.

In the present embodiment, the moving member 115 may be either connected or in contact with the writing shaft without being provided with the insertion holes 118*a*, 118*b*, etc. or may be an integral part of the writing shaft.

Further the projection 116 which the cam mechanism 108 has enabled the clip 103 to be smoothly and positively put in and out. The retaining part 110*a*, the cam mechanism 108 is to be inserted in not only enables the head 7 of the writing shaft 104 to be more positively maintained in the state of being projected out but also enables the movement stroke of the clip 103 to be made larger so that easy handling of the clip is possible.

In the present embodiment, the top of the rear slope 114 of the cam mechanism 108 may be made lower than the loser surface of the base part 9 of the clip 103 as shown by phantom lines in FIG. 3. At the forward portion of the cam mechanism 108 (the forward portion of the moving member 115), a projection 115*a* may be provided to prevent slipping and a slit 115*b* to give flexibility. The rear portion of the inside of the outer sleeve 101 may be provided with a projection 101*a* to prevent slipping wherein, due to the contact of projection 115*a* with moving member 115 by projection 101*a* in sleeve 101 cam mechanism can be prevented from slipping out of outer sleeve 101 when head member 105, spring 6 and writing shaft 104 are removed.

In setting up, the cam mechanism 108, is inserted in the outer sleeve 101 through the forward opening thereof moved backward over the projection in the outer sleeve 101 utilizing the flexibility due to the slit 115*b* and thereafter the clip 103 is attached through the long hole 102.

Figure 7:
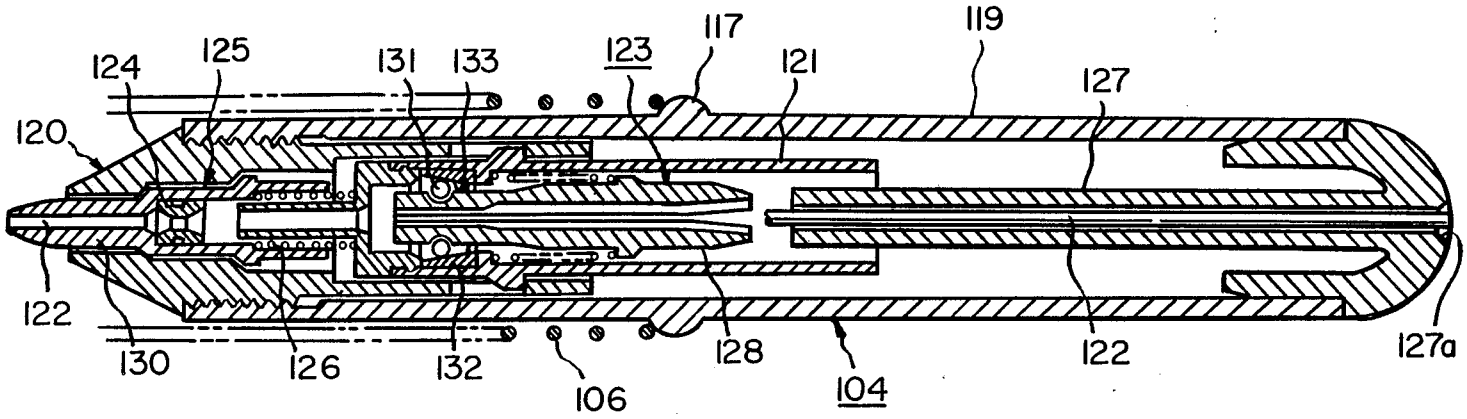
FIG. 7 is a vertical section of another example of a writing shaft which is applicable to the cam mechanism according to the present invention.

FIG. 7 shows another example of the writing shaft which can be applied to the present embodiment, wherein the writing shaft is a mechanical pencil described in Japanese utility model application 77145/1987 of the applicant.

The writing shaft for the mechanical pencil shown in FIG. 7 comprises a sleeve 121 slidably arranged in the head member 120, and a head feeding mechanism 123 inserted in the sleeve 212. Lead feeding mechanism 123 allows the forward movement of lead but prevents the retreating movement thereof. Slider 125 arranged in the head member 120, is provided with a frictional force-imparting member 124 for imparting the desired friction force to the lead 122. Spring 126 is for spring-loading the slider 125 so that the slider 125 is moved forward for automatic feeding of lead 122. Lead pipe 127 guides a lead 122 from the outside (through an opening 127*a*) to the lead-feeding mechanism 123. The outer sleeve 119 is provided with a spring bearing 119 for bearing a spring 6. Slider 125, has a slide pipe 130 and tube 132 has a tapered wall surrounding the lead chuck 128, and a ball 131 arranged between the tube 132 and the lead chuck 128.

Figure 8:
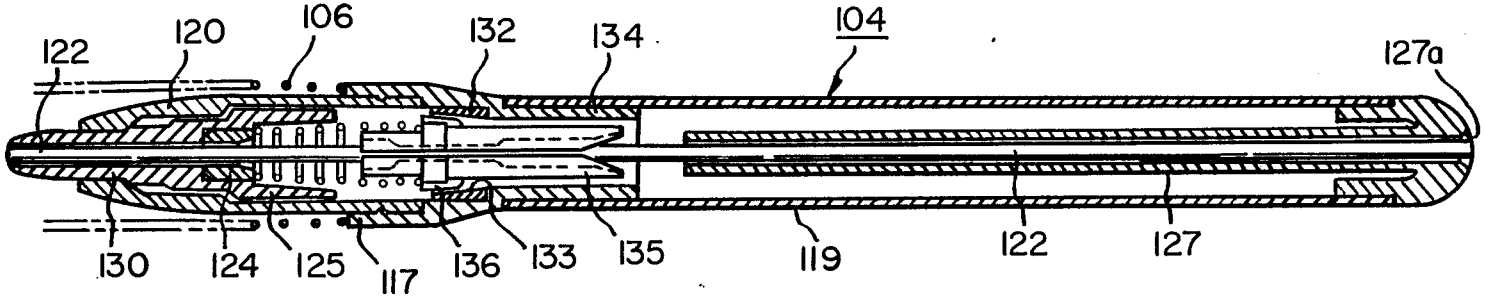
FIG. 8 is a vertical section of further example of a writing shaft which is applicable to the cam mechanism according to the present invention.
Figure 10:
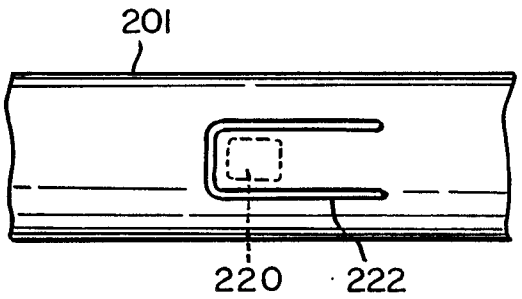
FIG. 10 is a diagram of the cut for the above embodiment shown in FIGs. 9(*a*) (*b*).

FIG. 8 shows a further example of the writing shaft which can be applied to the present embodiment wherein the writing shaft is for a mechanical pencil.

In FIg. 8, sleeve 134 connects the head member 120 with the outer sleeve 119 in which a tube 132 with a tapered wall 133 is inserted, or which may be an integral part of the sleeve 134. Lead chuck 135 is divided into two parts in the axial direction. The outer surface of the lead chuck 135 is provided with a projection 136 which is in contact with the tapered wall 133 of the tube 132. In FIG. 8, elements which are the same as those of the mechanical pencil shown in FIG. 7 are given like reference numerals.

In the example shown in FIg. 7, the ball 131 may be replaced with the projection 136 as shown in FIG. 8 which is contacted with he outer surface of the lead chuck 135.

The writing shaft for ball-point pen 104 shown in FIg. 3 can be replaced with the writing shaft for a mechanical pencil 104 shown in FIGs. 7 or 8.

The moving member 115 may be the integral part of the writing shaft for mechanical pencil 104, or it may be connected with the writing shaft for mechanical pencil through an adapter.

It goes without saying that the present invention can be applied for the shaft of a cutter.

Figure 9A:
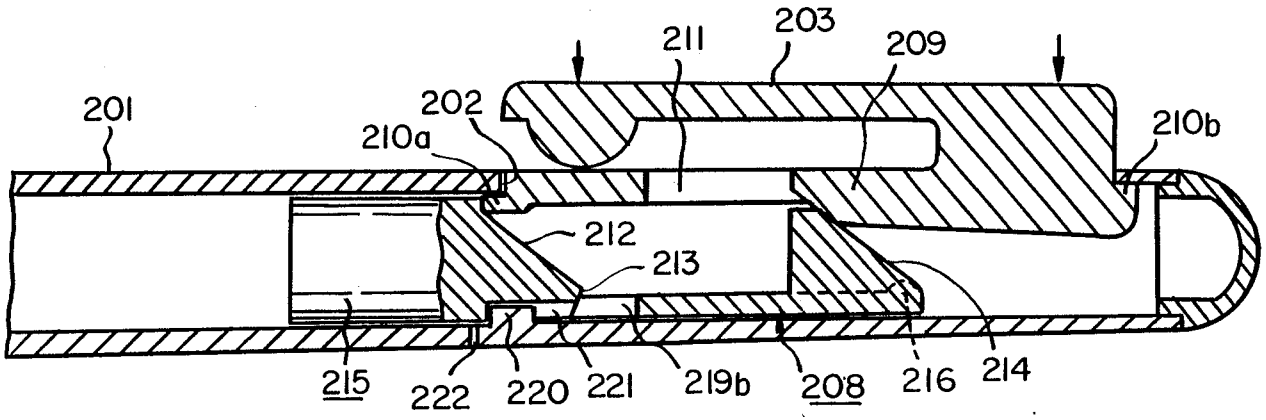
FIGS. 9(*a*) and (*b*) are partial vertical sectional views of a third embodiment of a cam mechanism according to the present invention, (a) showing the state when the clip is projected out and (b) the state when the clip is drawn in, respectively.
Figure 9B:
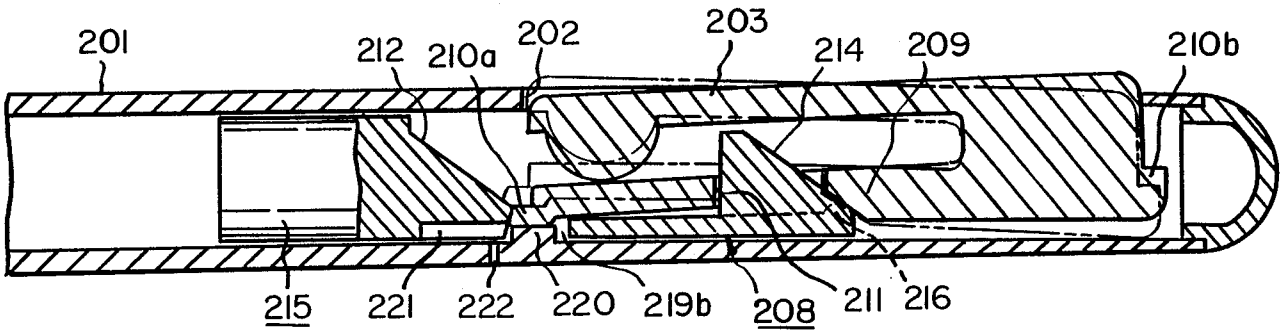

Referring to the further embodiment shown in FIG. 9(*a*) to 10, outer sleeve 201 has a long hole 202 in the direction made in the rear portion of the outer sleeve 201. A clip 203 is removably inserted in the long hole 202. A spring 206 is inserted between a spring bearing 217 of a writing shaft, for example ball-point pen 204 and a head member 205. Cam mechanism 8 can put the head of a ball-point pen 207 of the writing shaft 204 in and out, according to the operation for putting in and out the clip 203, against or through the spring force of the spring 206, provided between the writing shaft 204 and the clip 203.

In this embodiment, cam mechanism 208 comprises the front and rear retaining parts 210*a* and 210*b* formed in the base part 209 of the clip 203 engaged with the front and rear edge portions of the outer sleeve 201, respectively. Retaining hole 211 in the axial direction is forward of the central part of the base part 209. Moving part 215 has a front slope 212 which descends toward the rear thereof on which the front retaining part 210*a* is slidable. Retaining part 213 is formed behind the front slope 212 by which the front retaining part 213 is retained. Rear slope 214 descends toward the rear thereof and is retained by retaining hole 211. Small projection 216 is formed behind the rear slope 214. The forward portion of said moving member is connected with the rear portion of writing shaft 204, said rear portion of the writing shaft 204 being inserted in one insertion hole of two insertion holes adapted for two kinds of writing shafts with different outer diameters respectively.

The base area of the cam mechanism on the front retaining part 210*a* retained by retaining part 213 is provided with a retaining hole 219*a*.

A portion of the outer sleeve 201 is provided with a projection for release 220 and a cut 222, for example in the shape of "U", while the moving member 115 is provided with an insertion hole 221 in which the projection for release 220 is inserted.

In the above construction, for example, when the writing tool is used, the forward part of the clip 203 is pushed causing the front slope 212 and the rear slope 214 to be pushed by the front retaining part 210*a* and the edge of the retaining hole 211 formed in the base part 209 of the clip 203, respectively. The moving member 215 and the writing shaft 204 are moved forward against the spring 206 so that the projection for release 220 comes out of the insertion hole 221 while the head of ball-point pen 207 of the writing shaft 204 is projected out of the head member 205. At this time, the front retaining part 210*a* slides on the front slope 212 into the retaining hole 219 and is retained by retaining part 213 so that the clip can be kept in the state of being drawn in (FIG. 9(*a*)).

Further, for example, in carrying the writing tool or in drawing in the head of ball-point pen 207 of the writing shaft for ball-point pen 204, the outer sleeve release projection 220 pushes the front retaining part 210*a* so that the front retaining part 210*a* is released from the retaining part 213. The front retaining part 210*a* presses against the front slope 212 while the moving member 215 is moved slightly forward against the spring 206. The writing shaft for ball-point pen 204 and the moving member 215 are moved backward by the spring force of the spring 206 so that the clip 203 projects out. In this case, the backward movement of the moving member 215 can be achieved by inserting the release projection 220 in the insertion hole 221.

When the rear portion of the clip 203 is pushed the base part 209 is moved on the projection 216 of the rear slope 214 as a fulcrum so that the front retaining part 210*a* comes out of the retaining hole 219*b* and is released from the retaining part and pressed against the front slope 212 (shown by imaginary lines in FIG. 9(*b*)). Slanting surface on base part 209 about the retaining hole 211 is pressed against the rear slope 214 so that the moving member 215 moves slightly forward against the spring 206 and then the writing shaft 204 and the moving member 215 are moved backward by the spring force of the spring 206 so that the clip 203 projects out (FIG. 9(*a*)).

In this case it is preferable that the cam mechanism according to the present invention be provided with the projection 216 on both sides of the rear end of the rear slope 214 because the base part 209 of the clip 203 is supported on the projection 216 so that the release of the front retaining part 10*a* from the retaining hole 219*a* can be smoothly carried out utilizing the principle of the lever and fulcrum when the rear portion of the clip 203 is pushed.

Further as the forward portion of the moving part 215 of the cam mechanism 208 is provided with insertion holes adapted for two kinds of writing shafts with outer diameters which are different from each other in the same manner as the embodiment shown in FIG. 3 if the writing shaft 4 has a larger outer diameter, the writing shaft 204 can be inserted selectively in the larger diameter insertion holes while if the writing shaft 204 has a smaller outer diameter, the writing shaft 204 can be inserted in the hole 18*a* with the smaller inner diameter.

According to the present embodiment, for example, using the writing tool (in taking notes), the forward part of the clip 203 is pushed by which the cam mechanism 208 is moved against the spring 206, with the clip 203 being drawn in while the head of ball-point pen 207 of the writing shaft 204 for ball-point pen 204 projects out of the head member 205. Therefore it is possible to take notes without interference from the clip 203 since both states of the clip 203 being drawn in and the head of ball-point pen 207 of the writing shaft 204 projecting out of the head member can be maintained by retaining the front retaining part 210*a* of the clip 203 by retaining part 213.

Besides, for example, when carrying the writing tool or in withdrawing the head of ball-point pen 207 of the writing shaft 204, the release projection 22 pushes the base part on the front retaining part 210*a* which comes out of the retaining part 213. When the rear part of the clip 203 is pushed, the cam mechanism is moved by the spring force of the spring 206 thereby the state of the clip 203 being drawn in releases so that the clip 203 projects out while ball-point pen 207 of the writing shaft 204 is drawn in through the head member 205 of the outer sleeve 201. Thus it is possible to carry the writing tool with a pocket being put between the clip.

Further as the forward portion of the moving member 215 is provided with plural insertion holes for plural writing shafts having different diameters the same as in the previously described embodiment shown in FIG. e, an insertion hole can be selected to match the outer diameter of the writing shaft 204. Therefore without increasing the number of parts use of various writing shafts having different diameters from each other is possible.

In the present embodiment the moving member 215 can be connected with a writing shaft without being provided with the insertion holes, or it may be an integral part of the writing shaft.

Further, putting the head of ball-point pen 207 of the writing shaft 204 in and out can be very certainly and easily carried out, since by pushing the clip 203, the front retaining part 210*a* can be retained by the retaining part of the cam mechanism 208 while by the pushing or release projection 220 the front retaining part 210*a* can be released from the retaining part 213.

Further, at least one portion of the rear portion of the cam mechanism 208, or an area of said rear portion facing the outer sleeve 201 and on the lower surface of the clip 203, is provided with the projection 216, it is possible for the clip 203 to be smoothly and certainly put in and out. As the cam mechanism 208 is provided with the insertion hole 210*a* receiving the front retaining part 210*a* it is possible not only to more certainly maintain the projected state of the head of the writing shaft 204 but also make the movement stroke of the clip 203 for easy handling of the clip.

Figure 11A:
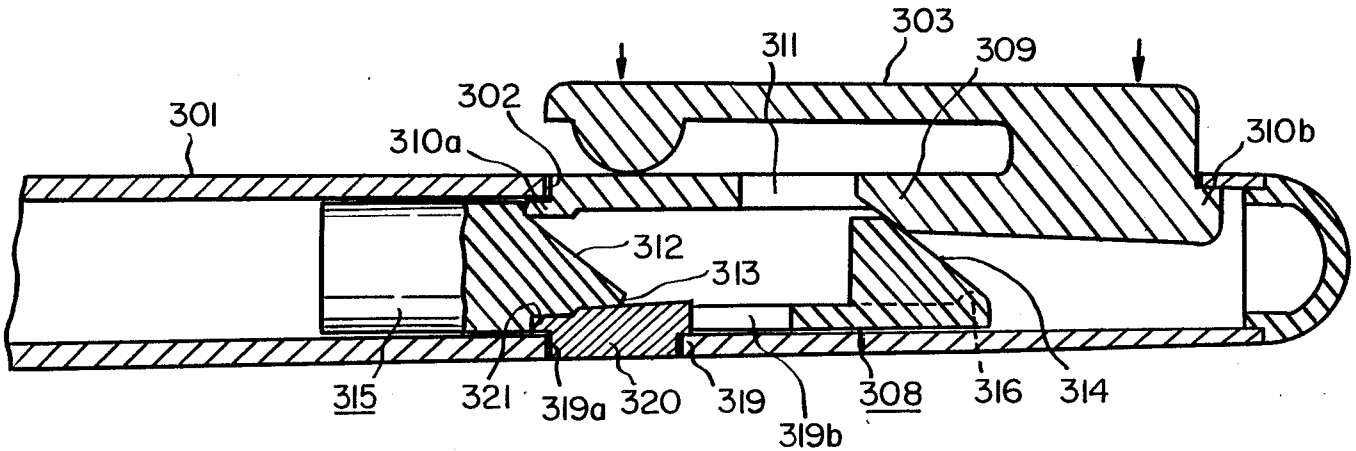
FIGS. 11(*a*) and (*b*) are partial vertical sectional views of a fourth embodiment of a mechanism according to the present invention, (a) showing the state when the clip is projected out and (b) the state when the clip is drawn in, in the present embodiment, respectively.
Figure 11B:
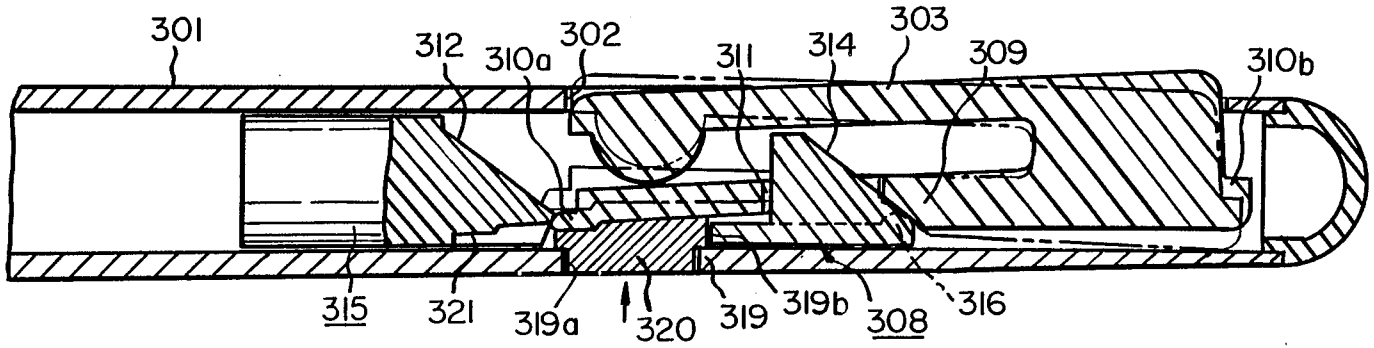

Referring to the further embodiment shown in FIGS. 11(*a*) (*b*), an outer sleeve 301 has a clip removably inserted in the long hole 302. A spring is inserted between a spring bearing of a writing shaft, for example of a writing shaft for ball-point pen as previously described so that the head of the ball-point pen of a writing shaft can be put in and out by operation for putting in and out the clip 303, against or through the spring force of the spring provided between a writing shaft and the clip 303.

In this embodiment, cam mechanism 308 comprises the front and rear retaining parts 310*a* and 310*b* formed in the base part 309 of the clip 303. Retaining parts 310*a* and 310*b* are engaged with the front and rear portion of the outer sleeve 301, respectively. Retaining hole 311 in the axial direction is formed in the central part of the base part 309. Moving part 315 includes front slope 312 which descends toward the rear thereof on which the front retaining part 310*a* is slidable. Retaining part 313 is formed on front slope 312 to act as a retainer. Rear slope 314 descends towards the rear thereof and is retained by retaining hole 311. Small projection 316 is formed behind the rear slope 314. The forward portion of said moving member is connected with the rear portion of the writing shaft 314, said rear portion of the writing shaft 314 being inserted in one of two insertion holes which are adapted for two kinds of writing shafts with outer diameters which are different from each other respectively.

A portion of the outer sleeve 301 facing the base portion on the side of the front retaining part 310*a* is retained therewith and a portion of the moving part 315 of the cam mechanism 308 is provided with retaining holes 319*a*, 319*b*, respectively. A release-operation member 220, is inserted in the insertion hole 319*a* formed in the outer sleeve 301 and brought into contact with an inner edge portion 319 of the retaining hole 319*a*, and is positioned facing the base part on the side of the front retaining art 310. An insertion hole 321 in which the release-operation member 320 is inserted is formed in the moving member 315.

In the above construction, for example, when the writing tool is used, the forward part of the clip 303 is pushed by which the front slope 312 and the rear slope 314 are pushed by the front retaining part 310*a* and the edge of the retaining hole 311 formed in the base part 309 of the clip 303,. respectively. The moving member 315 and the writing shaft are moved forward against a spring so that the release-operation member 320 comes out of the insertion hole 321 while the head of a ball-point per of a writing shaft is projected out of the head member as previously described. At this time, the front retaining part 310*a* slides on the front slope 312 into the retaining hole 319 and is retained by the retaining part 313 so that the clip can be kept in the state of being drawn in (FIG. 11(*b*)).

Further, for example, in carrying the writing tool or in drawing in the head of ball-point pen of the writing shaft for a ball-point pen in the outer sleeve the release-operation member 320 is pushed by which the front retaining part 310*a* is pushed so that the front retaining part 310*a* is released from the retaining part 313. The front retaining part 310*a* presses against the front slope 312 while the moving member 315 is moved slightly forward against the spring. Then the writing shaft for a ball-point pen and the moving member 315 are moved backward by the spring force of the spring so that the clip 303 projects out. In this case, the backward movement of the moving member 315 can be achieved by inserting the projection for release 320 in the insertion hole 321.

When the rear portion of the clip 303 is pushed, the base part 309 of the clip 303 is moved on the projection 316 of the rear slope 314 as a fulcrum so that the front retaining part 310*a* coed out of the retaining hole 319*b* and is released from the retaining part and pressed against the front slope 312 (shown by imaginary lines in FIG. 11(*b*)). Slanting surface on base part 309 about the retaining hole 311 is pressed against the rear slope 314 so that the moving member 315 is moved slightly forward against the spring. The writing shaft 304 and the moving member 315 are them moved backward by the spring force of the spring so that the clip 3 can project out (FIG. 11(*a*)).

In this case it is preferable that the cam mechanism according to the present invention be provided with the projection 316 on both sides of the rear end of the rear slope 314 because the base part 309 of the clip 303 are supported on the projection 316 so that the release of the front retaining part 310*a* from the retaining hole 319*b* can be smoothly carried out utilizing the principles of the lever and fulcrum when the rear portion of the clip 3 is pushed.

Further, as the forward portion of the moving part 315 of the cam mechanism 308 is provided with the insertion holes adapted for two kinds of writing shafts with outer diameters which are different from each other in the same manner as the embodiment shown in FIG. 3. If the writing shaft has larger outer diameter, it can be inserted selectively in the insertion hole with a larger inner diameter while if the writing shaft has a smaller outer diameter the writing shaft can be inserted in the hole with smaller inner diameter.

According to the present embodiment, for example, when using the writing tool (in taking notes), the forward part of the clip 303 is pushed by which the cam mechanism 308 is moved against the spring with the clip 303 being drawn in while the head of ball-point pen of the writing shaft for a ball-point pen can project out of the head member 305. Therefore is is possible to take notes without interference with the clip 303 since both the state of the clip 303 being drawn in and the state of the head of the ball-point pen of a writing shaft projected our of the head member can be maintained by retaining the front retaining part 310*a* of the clip 303 with the retaining part 313.

Otherwise, for example, when carrying the writing tool or in drawing in the head of ball-point pen of the writing shaft 304, the release-operation member 320 pushes the base part on the front retaining part 310*a*, which come out of the retaining part 313. When the rear part of the clip 303 is pushed, the cam mechanism is moved by the spring force of the spring so that the state of the clip 303 being drawn in is released so that the clip 303 projects out while the kind of ball-point pen of the writing shaft is drawn in through the head member 305 of the outer sleeve 301. Thus it is possible to carry the writing tool with a pocket being put between the clip 303.

Further, as the forward portion of the moving member 315 is provided with plural insertion holes for plural writing shafts having different diameters in the same manner as the previously described embodiment shown in FIG. 3, an insertion hole can be selected to match the outer diameter of the writing shaft. Therefore without increasing the number of parts use of various writing shafts having different diameters is possible.

In the present embodiment the moving member 315 can be connected with the writing shaft without being provided with the insertion holes, or it may be an integral part of the writing shaft.

Further, putting in and out of the head of ball-point pen of the writing shaft can be very certainly and easily carried out, since by pushing the clip 303, the front retaining part 310*a* can be retained with the retaining part of the cam mechanism 308 while by pushing the release operating member 320 the front retaining part 30*a* can be released from the retaining part 313.

Further, as at least part of the rear portion of the cam mechanism 308, or an area of said rear portion, facing the outer sleeve 301 and one lower surface of the clip 303 is provided with the projection 316, it is possible for the clip 303 to be smoothly and certainly put in and out. As the cam mechanism 308 is provided with the insertion hole 319*a* in which the front retaining part 310*a* is inserted, it is possible not only to more certainly maintain the projected state of the head of the writing shaft but also to improve the stroke of the movement of the clip 303 easy to handle.

Figure 12A:
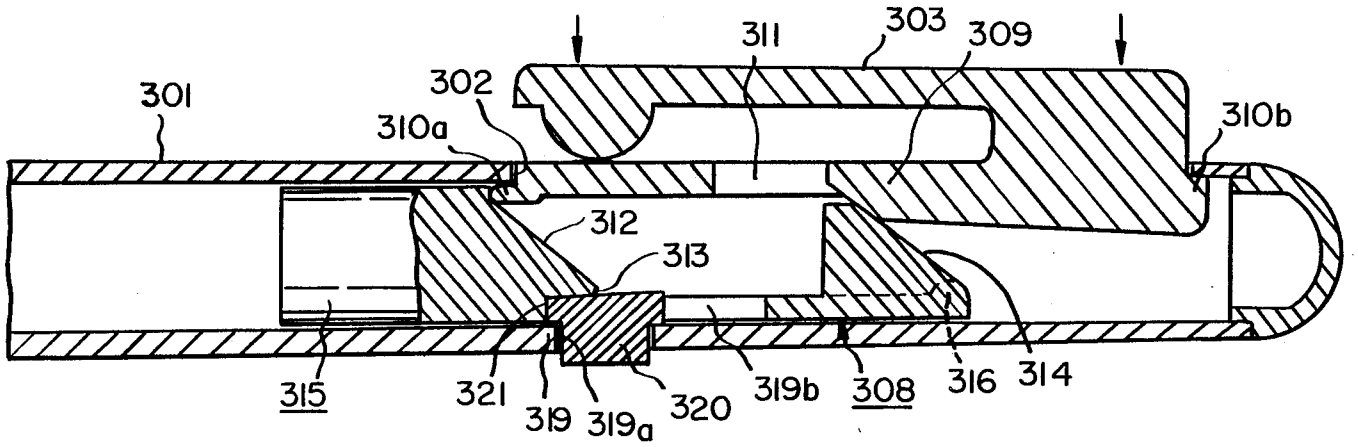
FIGS. 12(*a*) and (*b*) are vertical sectional views of parts of clip showing the state when the clip is projected out and the state when the clip is drawn in, in another embodiment, respectively.
Figure 12B:
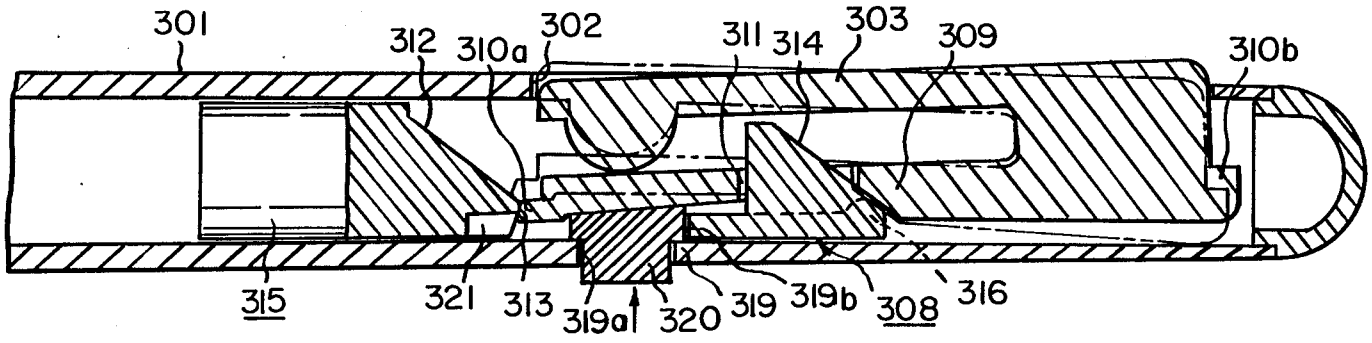

FIGS. 12 (*a*) (*b*) show another embodiment, where the end portion of the release-operation member 320 protrudes beyond the outer surface of the outer sleeve 301.

It goes without saying that the present invention can be equally applied for the shaft of a cutter.

This invention is not to be limited by the embodiment shown in the drawings and described in the description, which is given by way of example and not of limitation, but only in accordance with the scope of the appended claims.

I claim:

1. Mechanism for extending and retracting the head of a shaft through the head end of an outer sleeve, comprising; an outer sleeve (1), a long hole (2) formed in said outer sleeve (1), a clip (3) adapted to be moved in and out of said outer sleeve (1) through said long hole (2); a writing shaft (4) inserted in said outer sleeve (1); a cam mechanism (8) having front and rear slopes (12,14), actuating means (9,10*a*) integrally formed on said clip (3) engaging said front and rear slopes (12,14); a socket in said cam mechanism (8) receiving an end of said writing shaft (4); a spring (6) holding said writing shaft (4) in said socket; a retaining shoulder (13) at an inner end of said front slope for receiving and retaining said front actuating means (10*a*); a fulcrum member (16) at an inner end of said rear slope for receiving said rear actuating means (9); whereby downward pressure on a forward portion of said clip (3) moves said cam mechanism (8) and writing shaft (4) axially forward extending the head end (7) with said front actuating means (10*a*) being engaged in and retained by said retaining shoulder (13) and downward pressure on a rear portion of said clip (3) causes said rear actuating means (9) to engage said fulcrum member (16) releasing said front actuating means (10*a*) from said retaining shoulder (13) allowing said cam mechanism and said writing shaft to retract.

2. The mechanism according to claim 1 in which said fulcrum member comprises an upward curving projection (16) at the end of said rear slope (14) so that said rear actuating means (9) rides up said curved projection (16) when pressure is applied to a rear portion of said clip (6) dislodging said from actuating means (10*a*) from said retaining shoulder (13).

3. The mechanism according to claim 1 in which said rear actuating mechanism (9) is formed by a lengthwise hole in said clip (3) receiving said rear slope (14).

4. The mechanism according to claim 1 in which said front actuating means (10*a*) comprises a retaining portion formed on said clip for retaining said clip in said long hole (2) in said sleeve (1).

* * * * *